US012742608B2

(12) United States Patent
Martini

(10) Patent No.: US 12,742,608 B2
(45) Date of Patent: Sep. 22, 2026

(54) FIREARM ASSEMBLY WITH SEGREGATED TAKE DOWN LUGS

(71) Applicant: Elite Illyrian, Corp., Grosse Pointe, MI (US)

(72) Inventor: Ilir Martini, Grosse Pointe, MI (US)

(73) Assignee: Elite Illyrian, Corp., Grosse Pointe, MI (US)

( * ) Notice: Subject to any disclaimer, the term of this patent is extended or adjusted under 35 U.S.C. 154(b) by 0 days.

(21) Appl. No.: 18/406,458

(22) Filed: Jan. 8, 2024

(65) Prior Publication Data

US 2024/0230268 A1 Jul. 11, 2024

Related U.S. Application Data

(60) Provisional application No. 63/437,850, filed on Jan. 9, 2023.

(51) Int. Cl.
*F41A 21/48* (2006.01)

(52) U.S. Cl.
CPC ..... *F41A 21/48* (2013.01)

(58) Field of Classification Search
CPC ..... F41A 21/48; F41A 21/484; F41C 23/16
USPC ..... 42/75.02
See application file for complete search history.

(56) References Cited

U.S. PATENT DOCUMENTS 5,343,650 A * 9/1994 Swan ..... F41C 23/16 42/117
7,905,041 B1 * 3/2011 Davies ..... F41A 21/482 42/75.02
8,739,449 B2 6/2014 Patel
11,280,567 B1 * 3/2022 Hart ..... F41A 5/28
2010/0000400 A1 1/2010 Brown
2014/0068987 A1 3/2014 Burt
2015/0135572 A1 * 5/2015 Davies ..... F41C 23/16 42/71.01
2015/0135573 A1 * 5/2015 DiChario ..... F41A 3/66 42/75.02
2016/0187083 A1 * 6/2016 Underwood ..... F41A 3/66 42/75.02
2018/0045478 A1 2/2018 Couce
2020/0256636 A1 * 8/2020 Martini ..... F41A 35/02
2021/0293498 A1 * 9/2021 Underwood ..... F41A 3/66
2022/0018619 A1 1/2022 Noonan et al.

OTHER PUBLICATIONS

International Search Report and Written Opinion issued in corresponding International Application PCT/ US2024/010629, mailed May 2, 2024, 9 pages.

* cited by examiner

*Primary Examiner* — Bret Hayes
(74) *Attorney, Agent, or Firm* — Burris Law, PLLC

(57) ABSTRACT

A firearm assembly includes a lower receiver having a rear lug housing and a front lug housing, an upper receiver having a central cavity and a rear take down lug, and a barrel secured within the central cavity of the upper receiver. A handguard rail is configured to receive the upper receiver and the barrel therein, and the handguard rail includes a front take down lug. A rear take down pin is disposed through the rear take down lug and the rear lug housing, and a front take down pin is disposed through the front take down lug and the front lug housing. The handguard rail is configured to pivot about the front take down pin when the rear take down pin is removed.

23 Claims, 10 Drawing Sheets

FIREARM ASSEMBLY WITH SEGREGATED TAKE DOWN LUGS

CROSS-REFERENCE TO RELATED APPLICATION

This application claims priority to and the benefit of U.S. Provisional Application No. 63/437,850, filed on Jan. 9, 2023. The disclosure of the above application is incorporated herein by reference.

FIELD

The present disclosure relates to firearms, and more particularly to firearms having interchangeable barrels for different caliber ammunition.

BACKGROUND

The statements in this section merely provide background information related to the present disclosure and may not constitute prior art.

A variety of lightweight semi-automatic and automatic rifles have been in use for years in a variety of applications such as sport shooting, home defense, and military operations. Both the AR-15 semi-automatic rifle and the AK-47 automatic rifle are popular models that include interchangeable barrels, which generally accommodate different caliber ammunition. Different barrels can also have different lengths and twist rates, among other features, to provide the desired performance of the rifle by the user.

To remove and replace barrels, the rifle is generally disassembled in order to access the barrel, and the barrel is typically mounted inside an upper receiver. A handguard rail is also typically removed in order to access the barrel. Removing and replacing barrels can be time consuming, and a user must keep careful track of a number of parts and their sequence for disassembly and reassembly. Further, specialized tools are often required depending on the rifle model, and an improper installation can lead to a malfunction of the rifle.

These issues related to the removal and replacement of different barrels for firearms are addressed by the present disclosure.

SUMMARY

This section provides a general summary of the disclosure and is not a comprehensive disclosure of its full scope or all of its features.

In one form of the present disclosure, a firearm assembly comprises an upper receiver configured to receive a barrel therein, the upper receiver comprising a rear take down lug, and a handguard rail configured to receive the upper receiver and the barrel therein, the handguard rail comprising a front take down lug.

In variations of this firearm assembly, which may be implemented individually or in any combination: the front take down lug is an integral component of the handguard rail; the front take down lug is a separate part secured to the handguard rail; the front take down lug is secured to the handguard rail with mechanical fasteners; the upper receiver further comprises a set of retainer tabs disposed along opposed exterior side surfaces of a rear portion of the upper receiver, and the handguard rail comprises a set of opposed slots extending along a rear portion of the handguard rail, wherein the opposed slots are configured to receive the set of retainer tabs to locate the front take down lug relative to the rear take down lug; the set of retainer tabs are integral with the upper receiver; the set of retainer tabs are separate parts secured to the upper receiver; and the set of retainer tabs are secured to the upper receiver with mechanical fasteners.

In another form of the present disclosure, a firearm assembly comprises a lower receiver comprising a rear lug housing and a front lug housing, an upper receiver comprising a central cavity and a rear take down lug, a barrel secured within the central cavity of the upper receiver, a handguard rail configured to receive the upper receiver and the barrel therein, the handguard rail comprising a front take down lug, a rear take down pin disposed through the rear take down lug and the rear lug housing, and a front take down pin disposed through the front take down lug and the front lug housing. The handguard rail is configured to pivot about the front take down pin when the rear take down pin is removed.

In variations of this firearm assembly, which may be implemented individually or in any combination: the front take down lug is an integral component of the handguard rail; the front take down lug is a separate part secured to the handguard rail; the front take down lug is secured to the handguard rail with mechanical fasteners; the upper receiver further comprises a set of retainer tabs disposed along opposed exterior side surfaces of a rear portion of the upper receiver, and the handguard rail comprises a set of opposed slots extending along a rear portion of the handguard rail, wherein the opposed slots are configured to receive the set of retainer tabs to locate the front take down lug relative to the rear take down lug; the set of retainer tabs are integral with the upper receiver; the set of retainer tabs are separate parts secured to the upper receiver; and the set of retainer tabs are secured to the upper receiver with mechanical fasteners.

In still another form of the present disclosure, a firearm assembly comprises a lower receiver comprising a rear lug housing and a front lug housing, an upper receiver comprising a central cavity, a rear take down lug, and a set of retainer tabs disposed along opposed exterior side surfaces of a rear portion of the upper receiver, a barrel secured within the central cavity of the upper receiver, a handguard rail configured to receive the upper receiver and the barrel therein, the handguard rail comprising a front take down lug and a set of opposed slots extending along a rear portion of the handguard rail, a rear take down pin disposed through the rear take down lug and the rear lug housing, and a front take down pin disposed through the front take down lug and the front lug housing. The opposed slots are configured to receive the set of retainer tabs to locate the front take down lug relative to the rear take down lug, and the handguard rail is configured to pivot about the front take down pin when the rear take down pin is removed.

In variations of this firearm assembly, which may be implemented individually or in any combination: the front take down lug is an integral component of the handguard rail; the front take down lug is a separate part secured to the handguard rail; the front take down lug is secured to the handguard rail with mechanical fasteners; the set of retainer tabs are integral with the upper receiver; the set of retainer tabs are separate parts secured to the upper receiver; and the set of retainer tabs are secured to the upper receiver with mechanical fasteners.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
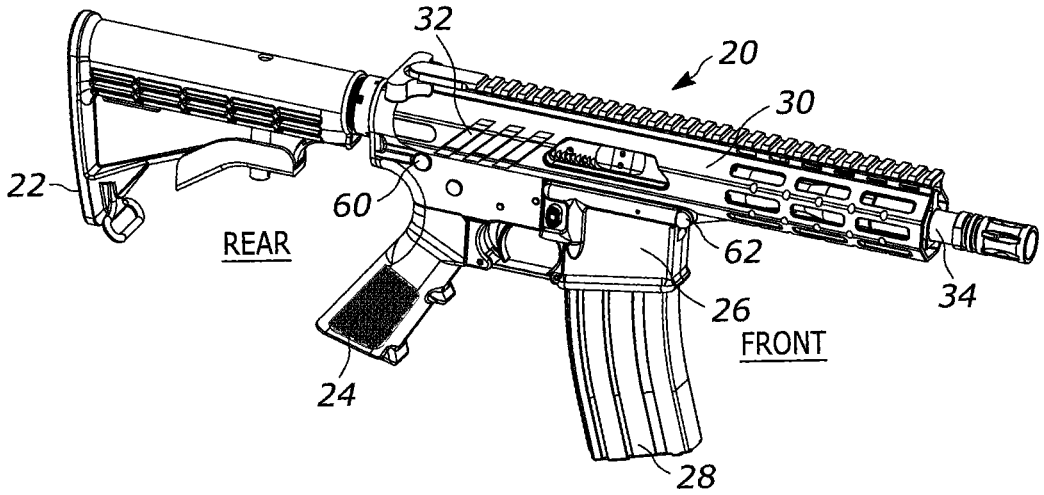
FIG. 1 is a perspective view of a firearm to which the teachings of the present disclosure are implemented.
Figure 2:
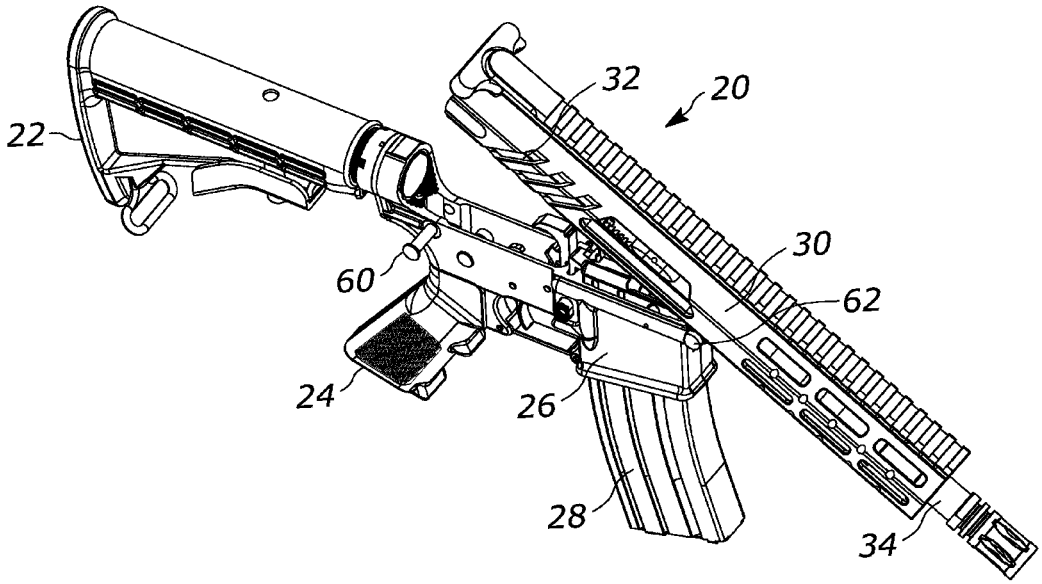
FIG. 2 is a perspective view of the firearm of FIG. 1 with a handguard rail, upper receiver, and barrel rotated about a front take down lug in accordance with the teachings of the present disclosure.
Figure 3:
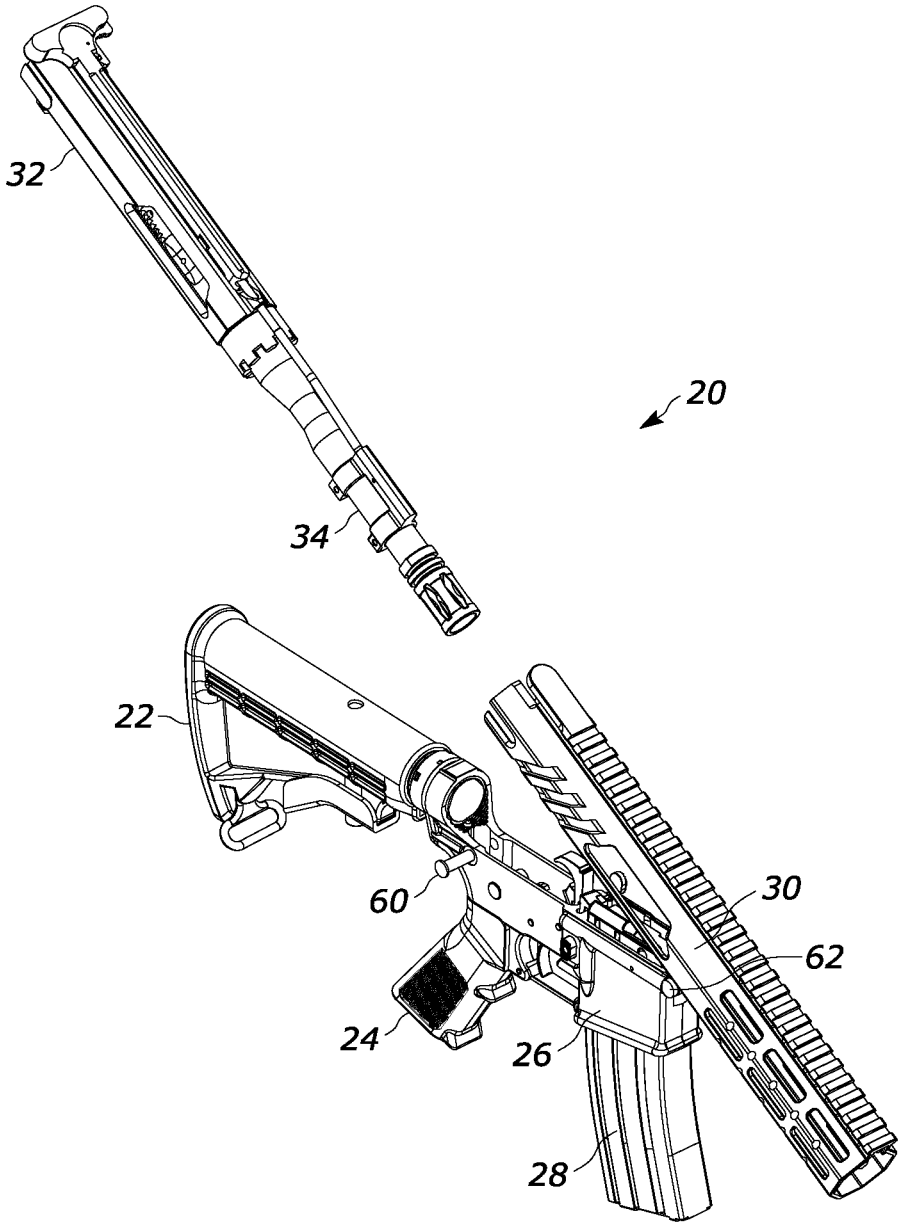
FIG. 3 is a perspective view of the firearm of FIG. 1 with an upper receiver and barrel removed from the handguard rail in accordance with the teachings of the present disclosure.
Figure 4:
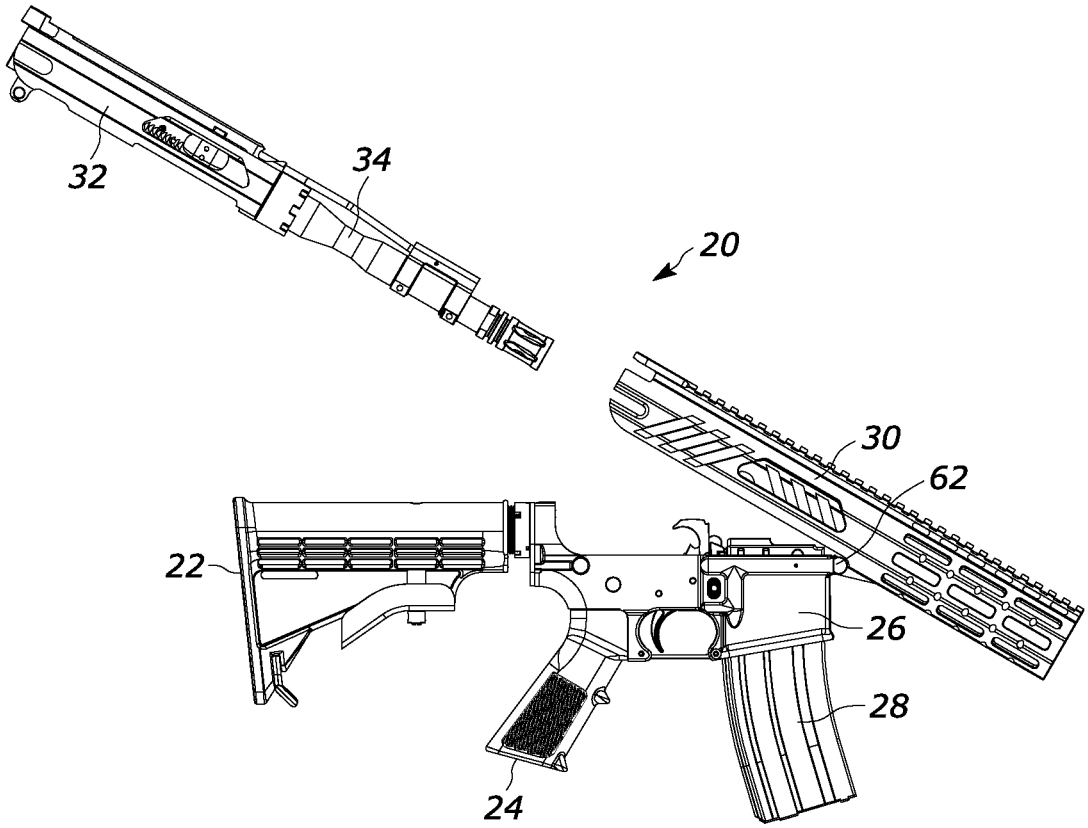
FIG. 4 is a side view of the firearm of FIG. 1 with an upper receiver and barrel removed from the handguard rail in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1-4, a firearm is illustrated and generally indicated by reference numeral 20. The firearm generally includes a buttstock 22, a grip 24, a lower receiver 26, a magazine 28, a handguard rail 30, an upper receiver 32, and a barrel 34. The firearm 20 generally includes several other components that are omitted herein for purposes of clarity. It should also be understood that the specific firearm model illustrated herein is merely exemplary, and thus the teachings of the present disclosure can be applied to a wide variety of firearm models while remaining within the scope of the present disclosure.

As described in greater detail below, the present disclosure provides an innovative design that segregates conventional take down lugs such that the handguard rail 30, along with the upper receiver 32 and the barrel 34 that are disposed therein, can be easily pivoted or rotated to allow for ease of removal and replacement of the barrel 34. And for spatial reference, the "front" portion and the "rear" portion are shown in FIG. 1 as these terms are used relative to various features of the present disclosure.

Figure 5:
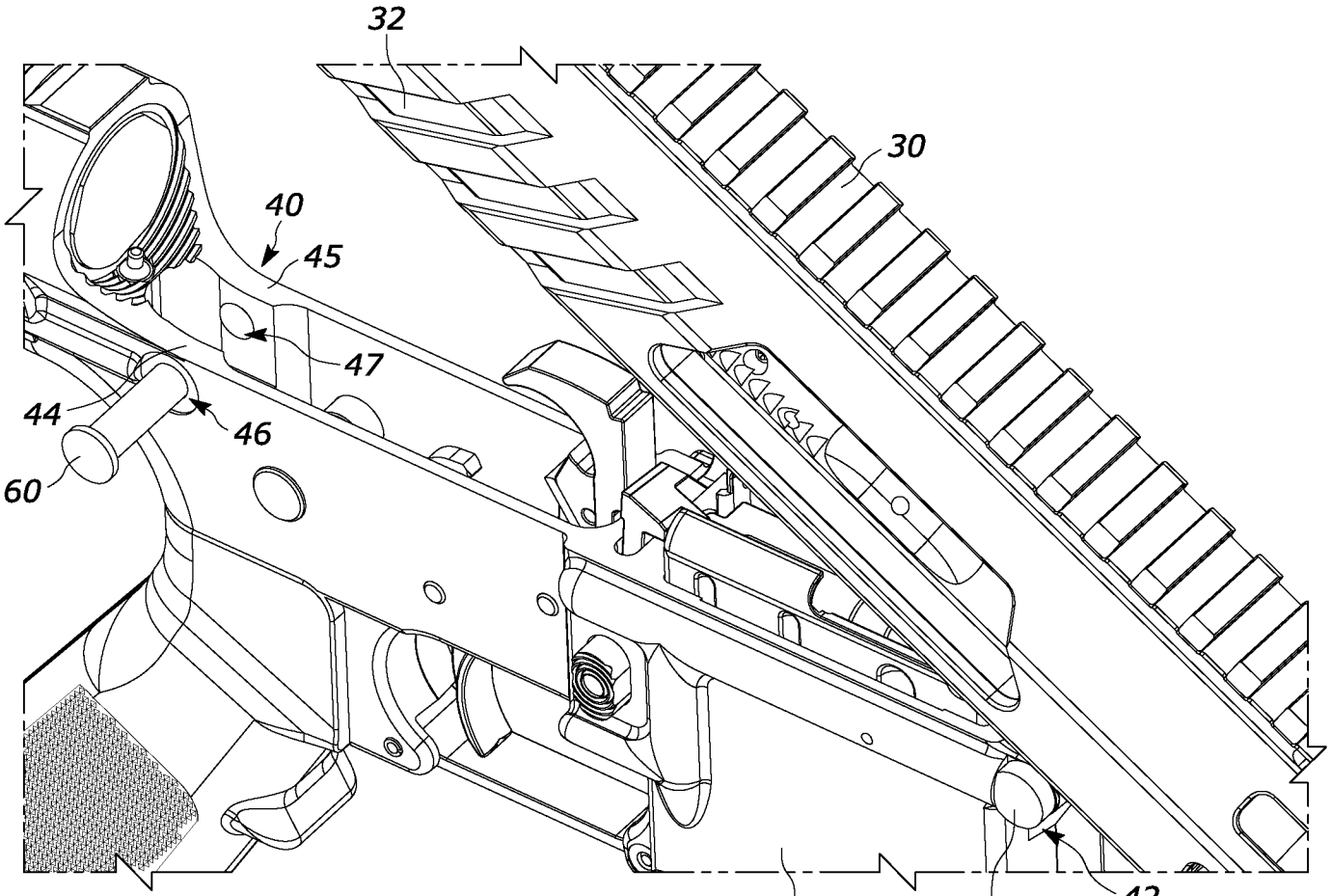
FIG. 5 is an enlarged perspective view of a lower receiver of the firearm with the rear take down pin removed and the handguard rail pivoted about a front take down pin in accordance with the teachings of the present disclosure.
Figure 6:
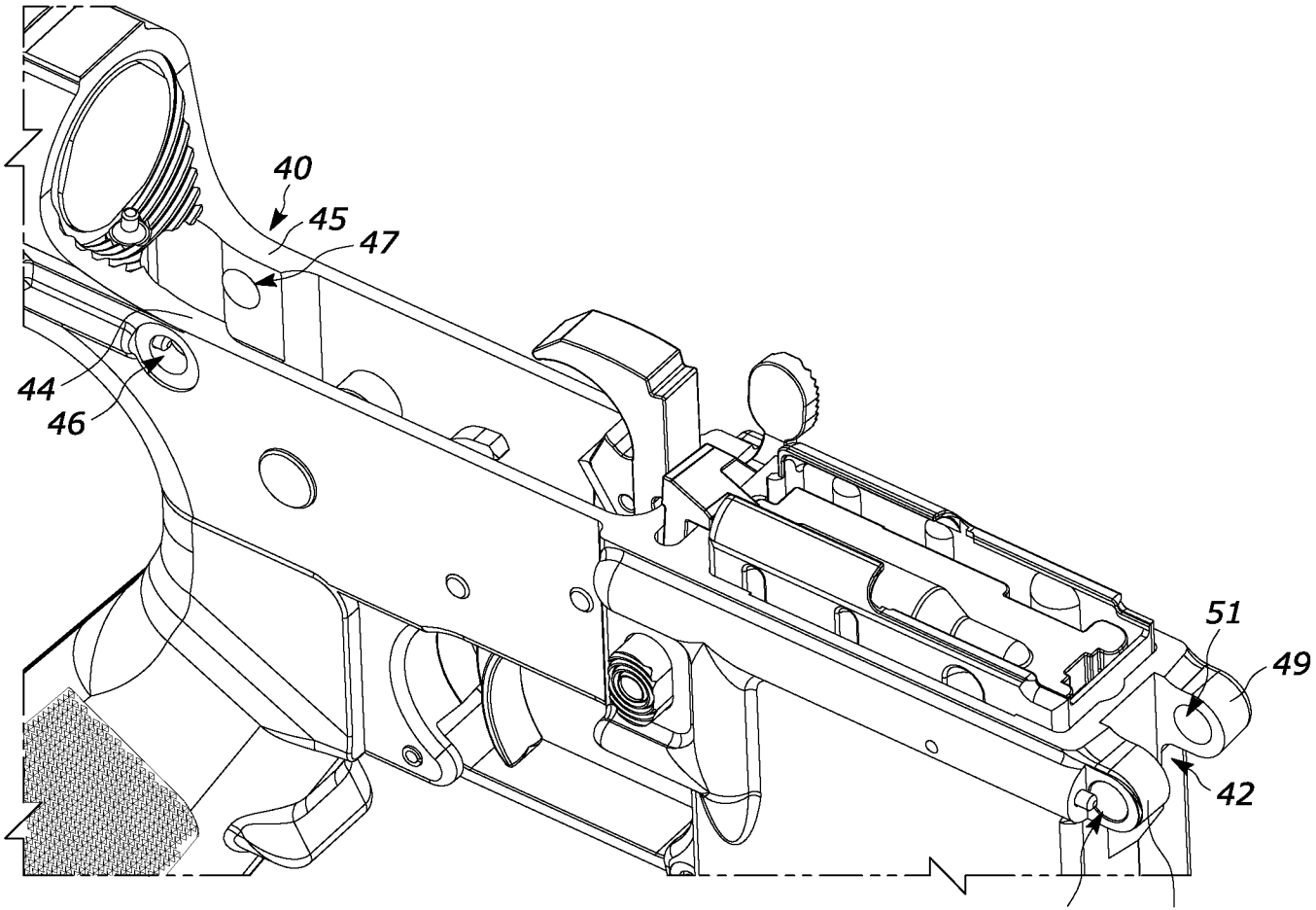
FIG. 6 is an enlarged perspective view of the lower receiver of the firearm (with the handguard rail, upper receiver, and barrel removed for clarity) illustrating a rear lug housing and a front lug housing in accordance with the teachings of the present disclosure.

Referring now to FIGS. 5 and 6, the lower receiver 26 includes a rear lug housing 40 and a front lug housing 42. More specifically, the rear lug housing 40 in this form comprises opposed rails 44/45 with corresponding openings, or holes 46/47 extending therethrough. The front lug housing 42 in this form comprises opposed lugs 48/49, which similarly have corresponding openings, or holes 50/51. The holes 46/47 and 50/51 are configured to receive a rear take down pin 60 and a front take down pin 62, respectively. The rear take down pin 60 and the front take down pin 62 are slidably engaged and generally press fit within the holes 46/47 and 50/51, respectively. These rear and front take down pins 60/62 are used to remove and pivot the handguard rail 30, along with the upper receiver 32 and the barrel 34 that are disposed therein, as described in greater detail below.

Figure 7:
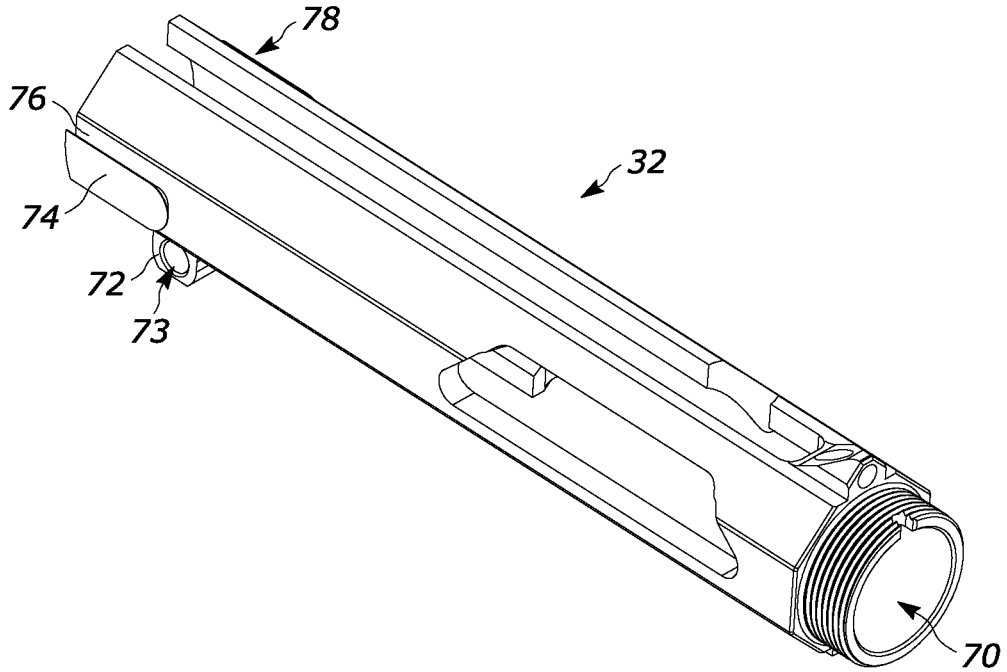
FIG. 7 is a front perspective view of an upper receiver constructed in accordance with the teachings of the present disclosure.
Figure 8:
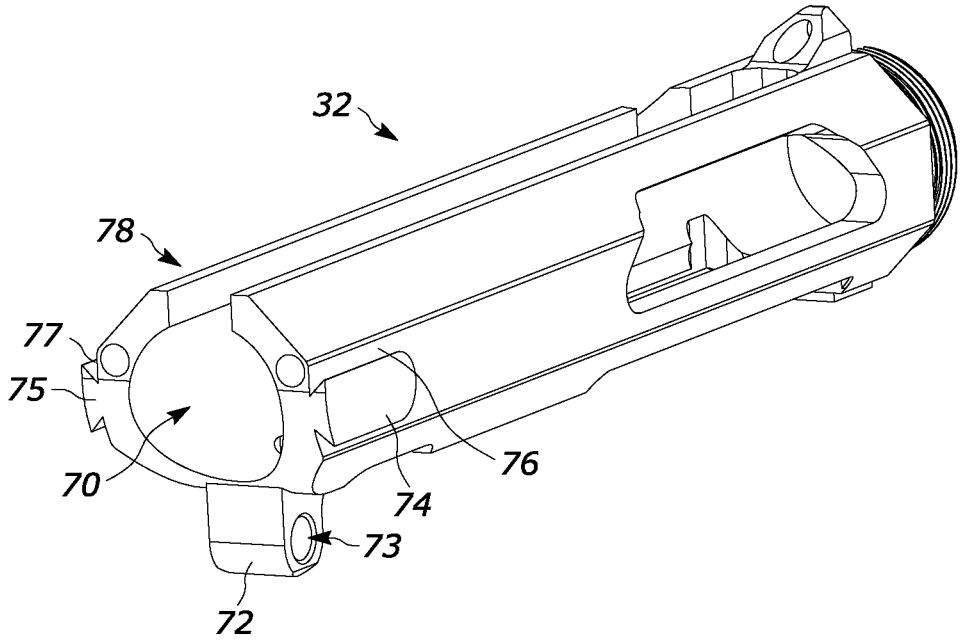
FIG. 8 is a rear perspective view of the upper receiver of FIG. 7.
Figure 9:
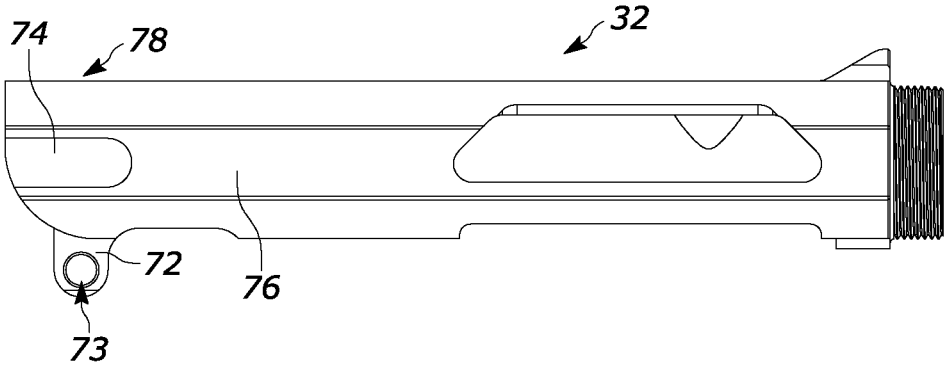
FIG. 9 is a side perspective view of the upper receiver of FIG. 7.

Referring to FIGS. 7-9, the upper receiver 32 is illustrated and now described in greater detail. As shown, the upper receiver 32 comprises a central cavity 70, a rear take down lug 72, and a set of retainer tabs 74/75 disposed along opposed exterior side surfaces 76/77 of a rear portion 78 of the upper receiver 32. The central cavity 70 is generally configured to receive the barrel 34 (FIGS. 1-4), among other components of the firearm 20. The rear take down lug 72 is configured to mate with the rear lug housing 40 of the lower receiver 26. More specifically, the rear take down lug 72 includes an opening, or hole 73 that is aligned with the holes 46/47 of the rear lug housing 40, and then the rear take down pin 60 is inserted through the holes 73, 46/47 to secure the upper receiver 32 to the lower receiver 26. Accordingly, the rear take down pin 60 is disposed through the rear take down lug 72 and the rear lug housing 40 of the lower receiver 26 (best shown in FIG. 1).

The retainer tabs 74/75 in this form are a dovetail shape as shown, and these retainer tabs 74/75 are configured to engage the handguard rail 30 as described in greater detail below to locate the upper receiver 32 relative to the handguard rail 30. Further, both the rear take down lug 72 and the retainer tabs 74/75 in this form as shown are integral with the upper receiver 32. For example, the rear take down lug 72 and the retainer tabs 74/75 can be integrally machined, molded, or otherwise formed into a single unitized part or component. Alternatively, either or both of the rear take down lug 72 and the retainer tabs 74/75 can be separate parts that are secured to the upper receiver 32, using by way of example, mechanical fasteners.

Figure 10:
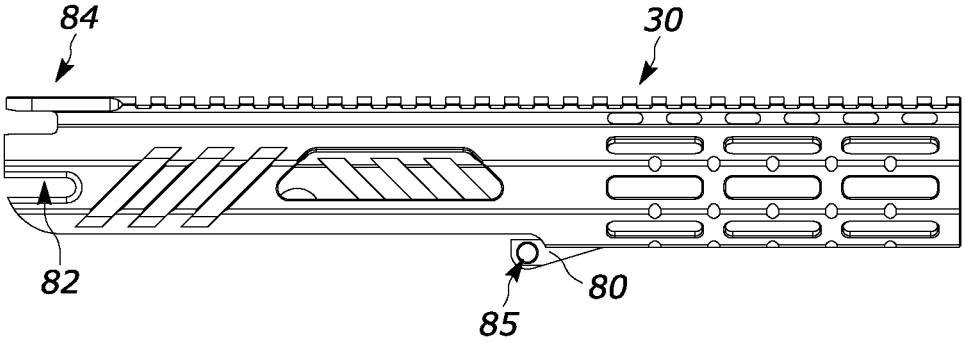
FIG. 10 is a side view of the handguard rail in accordance with the teachings of the present disclosure.
Figure 11:
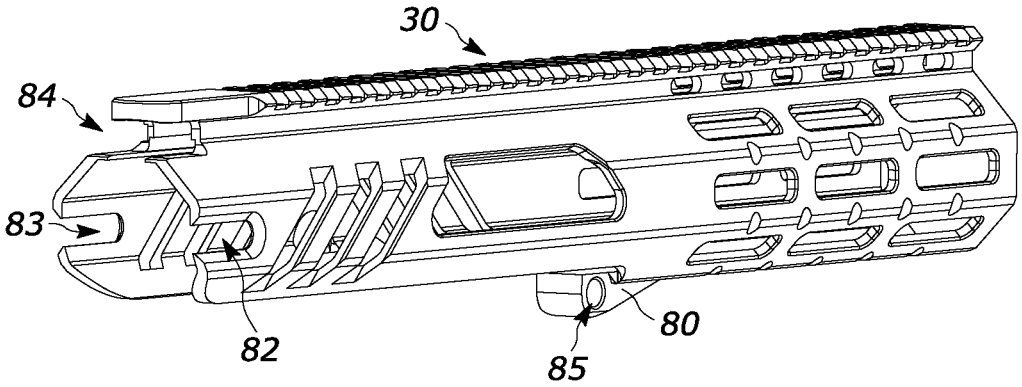
FIG. 11 is a rear perspective view of the handguard rail of FIG. 10.

Turning now to FIGS. 10-11, the handguard rail 30 is illustrated and now described in greater detail. As shown, the handguard rail 30 comprises a front take down lug 80 and a set of opposed slots 82/83 extending along a rear portion 84 of the handguard rail 30. The front take down lug 80 is configured to mate with the front lug housing 42 of the lower receiver 26. More specifically, the front take down lug 80 includes an opening, or hole 85 that is aligned with the holes 50/51 of the front lug housing 42, and then the front take down pin 62 is inserted through the holes 85, 50/51 to secure the handguard rail 30 to the lower receiver 26. Accordingly, the front take down pin 62 is disposed through the front take down lug 80 and the front lug housing 42 of the lower receiver 26 (best shown in FIG. 5).

Figure 12:
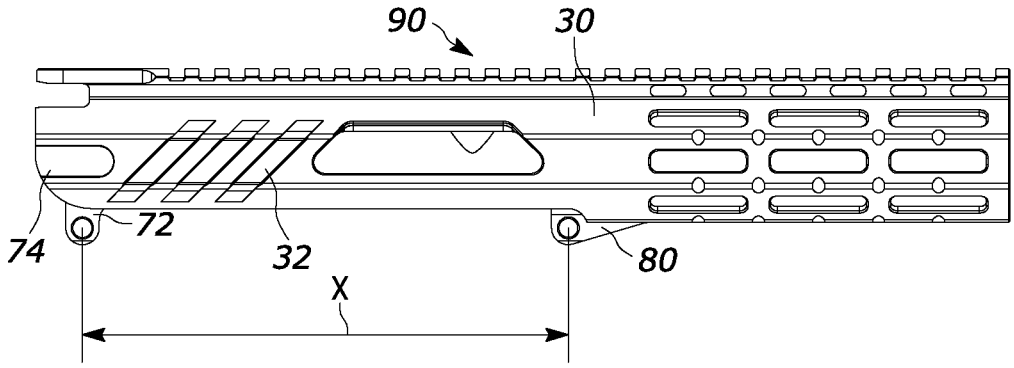
FIG. 12 is a side view of the upper receiver disposed within the handguard rail in accordance with the teachings of the present disclosure.
Figure 13:
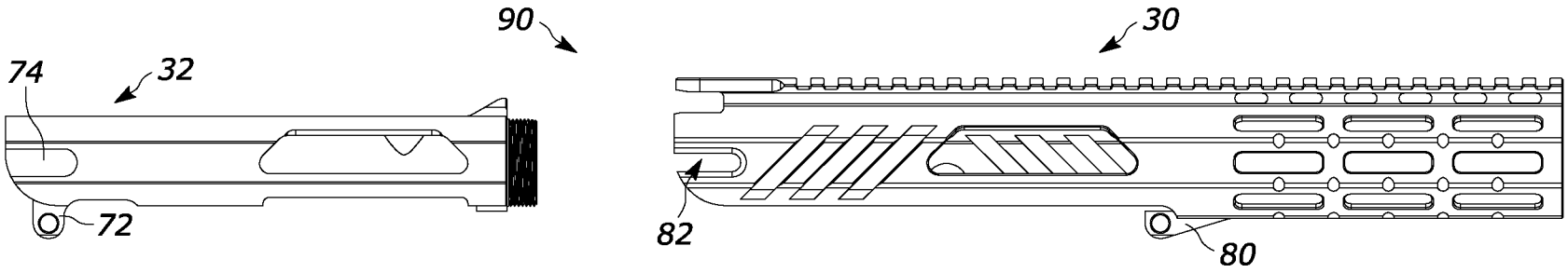
FIG. 13 is a side view of the upper receiver removed from the handguard rail in accordance with the teachings of the present disclosure.
Figure 14:
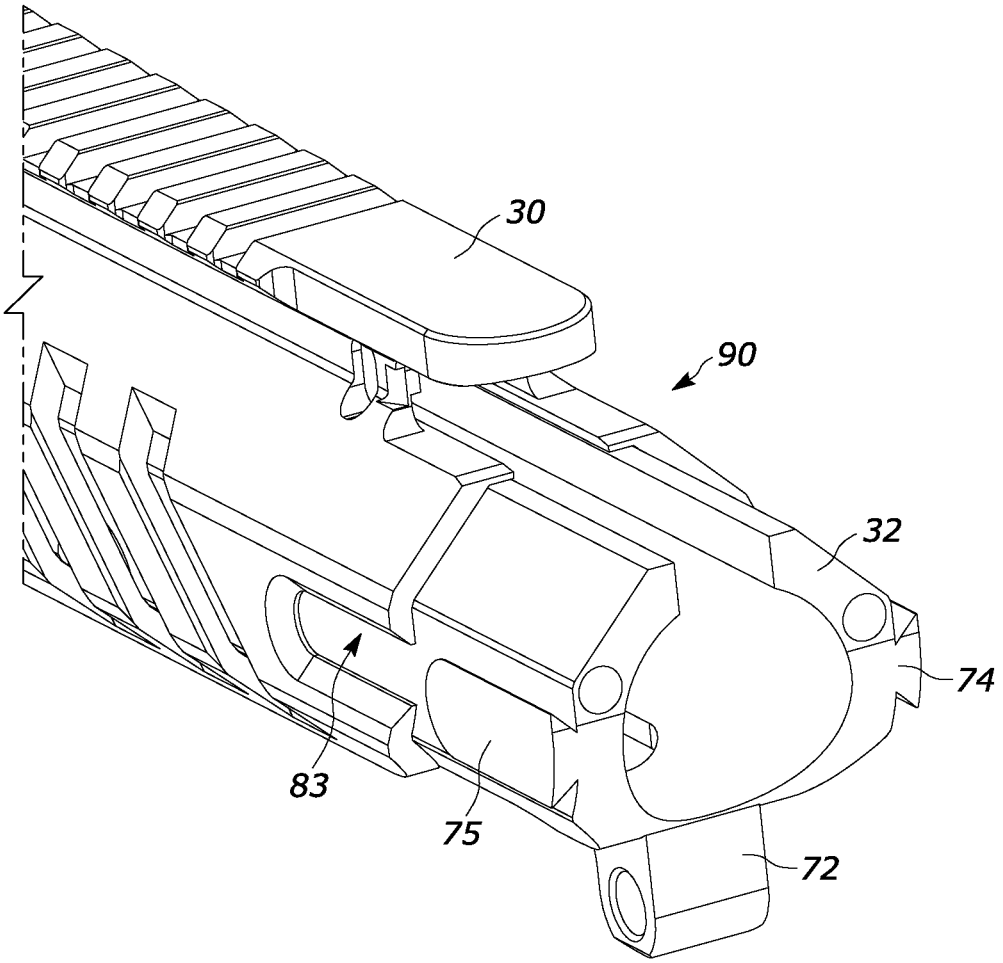
FIG. 14 is an enlarged rear perspective view of the upper receiver being inserted within the handguard rail, illustrating retainer tabs constructed in accordance with the teachings of the present disclosure.

Referring now to FIGS. 12-14, a firearm assembly of the handguard rail 30 and the upper receiver 32 is illustrated and generally indicated by reference numeral 90. As shown, the opposed slots 82/83 of the handguard rail 30 are configured to receive the set of retainer tabs 74/75 of the upper receiver 32. In this form, the opposed slots 82/83 are beveled as shown to receive the dovetail shape of the retainer tabs 74/75. As the upper receiver 32 is inserted into the handguard rail 30, the retainer tabs 74/75 engage the opposed slots 82/83. When fully engaged (FIG. 12), the retainer tabs 74/75 and opposed slots 82/83 function to locate the front take down lug 72 relative to the rear take down lug 80, as shown by the dimension "X."

Referring also to FIGS. 1-4, when the handguard rail 30 and upper receiver 32 are installed for use, the rear take down pin 60 and the front take down pin 62 are secured to the rear take down lug 72 and the front take down lug 80, respectively, as described above. When a user wants to remove the barrel 34 for cleaning or to replace with a different barrel, the user simply removes the rear take down pin 60, and then the handguard rail 30, and more specifically the front take down lug 80, can be pivoted about the front take down pin 62 as shown. The user then unlocks and slides the upper receiver 32 and the barrel 34 out from the handguard rail 30 and proceeds with the desired modification/action. Accordingly, the present disclosure segregates the take down lugs into separate components, namely to both the upper receiver 32 and the handguard rail 30, for ease of maintenance and use.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A firearm assembly comprising:

an upper receiver configured to receive a barrel therein, the upper receiver comprising a rear take down lug, the rear take down lug comprising an opening configured to receive a rear take down pin; and a handguard rail configured to receive the upper receiver and the barrel therein, the handguard rail comprising a front take down lug, the front take down lug comprising an opening configured to receive a front take down pin.

2. The firearm assembly according to claim 1, wherein the front take down lug is an integral component of the handguard rail.

3. The firearm assembly according to claim 1, wherein the front take down lug is a separate part secured to the handguard rail.

4. The firearm assembly according to claim 3, wherein the front take down lug is secured to the handguard rail with mechanical fasteners.

5. The firearm assembly according to claim 1, wherein the upper receiver further comprises a set of retainer tabs disposed along opposed exterior side surfaces of a rear portion of the upper receiver, and the handguard rail comprises a set of opposed slots extending along a rear portion of the handguard rail, wherein the opposed slots are configured to receive the set of retainer tabs to locate the front take down lug relative to the rear take down lug.

6. The firearm assembly according to claim 5, wherein the set of retainer tabs are integral with the upper receiver.

7. The firearm assembly according to claim 5, wherein the set of retainer tabs are separate parts secured to the upper receiver.

8. The firearm assembly according to claim 7, wherein the set of retainer tabs are secured to the upper receiver with mechanical fasteners.

9. A firearm assembly comprising:

a lower receiver comprising a rear lug housing and a front lug housing, the rear lug housing comprising opposed rails with corresponding openings and the front lug housing comprising opposed lugs with corresponding openings;

an upper receiver comprising a central cavity and a rear take down lug, the rear take down lug comprising an opening;

a barrel secured within the central cavity of the upper receiver;

a handguard rail configured to receive the upper receiver and the barrel therein, the handguard rail comprising a front take down lug, the front take down lug comprising an opening;

a rear take down pin disposed through the opening of the rear take down lug and the corresponding openings of the opposed rails of the rear lug housing; and a front take down pin disposed through the opening of the front take down lug and the corresponding openings of the opposed lugs of the front lug housing, wherein the handguard rail is configured to pivot about the front take down pin when the rear take down pin is removed.

10. The firearm assembly according to claim 9, wherein the front take down lug is an integral component of the handguard rail.

11. The firearm assembly according to claim 9, wherein the front take down lug is a separate part secured to the handguard rail.

12. The firearm assembly according to claim 11, wherein the front take down lug is secured to the handguard rail with mechanical fasteners.

13. The firearm assembly according to claim 9, wherein the upper receiver further comprises a set of retainer tabs disposed along opposed exterior side surfaces of a rear portion of the upper receiver, and the handguard rail comprises a set of opposed slots extending along a rear portion of the handguard rail, wherein the opposed slots are configured to receive the set of retainer tabs to locate the front take down lug relative to the rear take down lug.

14. The firearm assembly according to claim 13, wherein the set of retainer tabs are integral with the upper receiver.

15. The firearm assembly according to claim 13, wherein the set of retainer tabs are separate parts secured to the upper receiver.

16. The firearm assembly according to claim 15, wherein the set of retainer tabs are secured to the upper receiver with mechanical fasteners.

17. A firearm assembly comprising:

a lower receiver comprising a rear lug housing and a front lug housing, the rear lug housing comprising opposed rails with corresponding openings and the front lug housing comprising opposed lugs with corresponding openings;

an upper receiver comprising a central cavity, a rear take down lug, the rear take down lug comprising an opening, and a set of retainer tabs disposed along opposed exterior side surfaces of a rear portion of the upper receiver;

a barrel secured within the central cavity of the upper receiver;

a handguard rail configured to receive the upper receiver and the barrel therein, the handguard rail comprising a front take down lug, the front take down lug comprising an opening, and a set of opposed slots extending along a rear portion of the handguard rail;

a rear take down pin disposed through the opening of the rear take down lug and the corresponding openings of the rear lug housing; and a front take down pin disposed through the opening of the front take down lug and the corresponding openings of the front lug housing, wherein the opposed slots are configured to receive the set of retainer tabs to locate the front take down lug relative to the rear take down lug, and wherein the handguard rail is configured to pivot about the front take down pin when the rear take down pin is removed.

18. The firearm assembly according to claim 17, wherein the front take down lug is an integral component of the handguard rail.

19. The firearm assembly according to claim 17, wherein the front take down lug is a separate part secured to the handguard rail.

20. The firearm assembly according to claim 19, wherein the front take down lug is secured to the handguard rail with mechanical fasteners.

21. The firearm assembly according to claim 17, wherein the set of retainer tabs are integral with the upper receiver.

22. The firearm assembly according to claim 17, wherein the set of retainer tabs are separate parts secured to the upper receiver.

23. The firearm assembly according to claim 22, wherein the set of retainer tabs are secured to the upper receiver with mechanical fasteners.

* * * * *